US006957975B2

(12) United States Patent
Kuroda et al.

(10) Patent No.: US 6,957,975 B2
(45) Date of Patent: Oct. 25, 2005

(54) PLUG CONNECTOR HOUSING WITH LOCKING MECHANISM AND PLUG CONNECTOR HAVING SUCH HOUSING

(75) Inventors: Keiji Kuroda, Amagasaki (JP); Kiyoshi Aramoto, Higashiosaka (JP); Ryo Moriwake, Izumiotsu (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/792,965

(22) Filed: Mar. 3, 2004

(65) Prior Publication Data

US 2004/0175982 A1 Sep. 9, 2004

(30) Foreign Application Priority Data

Mar. 7, 2003 (JP) ..... 2003-062578

(51) Int. Cl.[7] ..... H01R 13/627
(52) U.S. Cl. ..... 439/358
(58) Field of Search ..... 439/367, 350, 439/352, 353, 358

(56) References Cited

U.S. PATENT DOCUMENTS 3,523,269 A * 8/1970 Bissland et al. ..... 439/358
4,832,625 A * 5/1989 Puerner ..... 439/681
6,663,412 B2 * 12/2003 Aramoto et al. ..... 439/358

FOREIGN PATENT DOCUMENTS

| | | |
|---|---|---|
| JP | 03016674 | 2/1991 |
| JP | 06029058 | 2/1994 |
| JP | 3094668 | 8/2000 |
| JP | 2002190351 | 7/2002 |

* cited by examiner

*Primary Examiner*—Briggitte R. Hammond
(74) *Attorney, Agent, or Firm*—W. F. Fasse; W. G. Fasse

(57) ABSTRACT

A plug connector with a locking mechanism includes a housing having a body and an inserting part, a contact received therein, lock arms provided on both sides in a width direction of the housing and extending rearward in a depth direction and having protrusions provided at top ends thereof, and control arms provided on both sides in the width direction of the housing and extending forwardly in the depth direction. The control arms transmit forces working inwardly in the width direction to the lock arms. The control arms are arranged in such a way that when the inserting part is inserted into the cavity of the receptacle connector, the protrusions will be caught on the catching faces of the receptacle connector, and when the top ends of the control arms are pressed inwardly in the width direction, the protrusions will be released from the catching faces.

20 Claims, 13 Drawing Sheets

PLUG CONNECTOR HOUSING WITH LOCKING MECHANISM AND PLUG CONNECTOR HAVING SUCH HOUSING

BACKGROUND OF THE INVENTION

1. Field of the Invention

The present invention relates to a plug connector with a locking mechanism, which will be locked in a receptacle connector when it is inserted into the receptacle connector and can be withdrawn out of the receptacle connector when an unlocking operating is performed on the plug connector. The invention further relates to a plug connector housing with a locking mechanism as a component thereof.

2. Related Art

Japanese Patent Publication 3094668 discloses a connector with a locking mechanism comprising a plug connector, a molded cover enclosing the plug connector, lock levers cantilevered respectively on the inward faces of both side walls in the width direction of a cover body constituting the molded cover, and a jack connector corresponding to the plug connector. The connectors are locked together or unlocked by fitting or releasing hooks provided on the other ends of the lock levers and fitting parts provided on the jack connector at positions corresponding to the hooks. The catching of the hooks on the fitting parts will be released when tongues formed by key-shaped slits made in the side walls of the cover body are pressed from outside the undergo inwardly directed elastic deformation.

Japanese Utility Model Unexamined Publication Heisei 3-16674 discloses a locking mechanism of a connector comprising a cable-side body for receiving a socket made of an insulator for holding one set of contacts for electrical connection, and a stand-side member for receiving a socket made of an insulator for holding the counterpart set of contacts. Inner walls are provided on both sides inside the casing of the cable-side body and extend linearly in the longitudinal direction. Outer walls limit the outer side of the casing. Lock plates are provided in spaces between the inner walls and the outer walls. Portions of the lock plates close to first ends thereof make point contact with protrusions provided on the inner walls. Fitting protrusions are provided by making the other second ends of the lock plates protrude outwardly from the outer walls of the casing so that the protrusions can fit into openings in the outer walls of the stand-side member. Finger-shaped parts protrude inwardly from the intermediate parts of the lock plates to contact the outer walls of the inner walls to constantly position the fitting protrusions outside through spring action. A cover member facing finger-pressing parts is provided for controlling the finger-shaped parts from the outside of the casing of the cable-side body.

Japanese Patent Unexamined Publication 2002-190351 discloses an electric connector arrangement comprising a first connector and a second connector for fitting together in a first direction and having a lock for locking the first connector and the second connector together. The first connector is provided with a lock piece and an unlocking arm for undoing or releasing the fitting of the lock piece, which is formed into an approximately L-shape having a fitting part on one end thereof for fitting with a fitting part of the second connector and a protruding part on the other end thereof for contacting a cam of the unlocking arm. The second connector is provided with a metallic shell having a catching part for fitting with the fitting part. When the first connector and the second connector are fitted together, the unlocking arm will be displaced into a second direction crossing the first direction so as to make the cam and the protruding part contact with each other, to displace the lock piece into a third direction crossing the first and second directions and undo or release the fitting between the fitting part and the catching part.

In the case of the connector with the locking mechanism of Japanese Patent Publication 3094668, the lock levers extend, inside the mold cover, on both sides of the plug connector from the rear to the front of the plug connector, and the hooks are released from the fitting parts of the counterpart jack connector by pressing the tongues with one's fingers to apply forces to the intermediate parts of the lock levers. In the case of the connector of Japanese Utility Model Unexamined Publication Heisei 3-16674, the lock plates extend, inside the casing of the cable-side body, on both sides of the socket from the rear to the front of the socket, and unlocking is effected by pressing the finger-pressing parts with one's fingers to apply forces to the intermediate parts of the lock plates so as to remove the protrusions for fitting from the openings of the counterpart stand-side member. As for connectors of this kind, it is keenly desired to minimize the forces required for unlocking. To solve this problem, the root end of the lock lever or the root end of the lock plate may be extended toward the rear of the plug connector or the socket. Or the point of action in which the force is applied to the lock lever or the lock plate may be shifted closer to the front of the plug connector of the socket. However, when the former measure is taken, the connectors will get larger in size, contrary to the efforts of making the connectors more compact. When the latter measure is taken, the tongue or the finger-pressing part is brought closer to the counterpart jack connector or socket, which makes it very difficult or impossible to unlock by pressing the tongues or the finger-pressing parts with one's fingers when the counterpart jack connector or socket is mounted in a narrow space leaving only a tight work space.

The connector of Japanese Patent Unexamined Publication 2002-190351 differs in the structure of the locking mechanism from the connectors of Japanese Patent Publication 3094668 and Japanese Utility Model Unexamined Publication Heisei 3-16674, the lock pieces, however, extend on both sides of the plug connector from the rear to the front, and the fitting parts thereof are released from the fitting parts of the counterpart receptacle connector by pressing the unlocking arms with one's fingers to apply forces to the protruding parts of the lock pieces. Accordingly, when the root ends of the lock pieces are extended toward the rear of the plug connector, the connectors will get larger, contrary to the efforts of making them more compact. When the unlocking arms are extended toward the front of the plug connector for the same purpose, it will pose a problem that it is very difficult or impossible to unlock by pressing the unlocking arms with one's fingers when the counterpart receptacle connector is mounted in a narrow space with a tight working space. Moreover, as the fitting part of the locking piece fits with the fitting part of the receptacle connector by being displaced in the thickness direction of the plug connector, this detracts from the efforts of reducing the plug connector and the receptacle connector in thickness.

SUMMARY OF THE INVENTION

The present invention was made in view of the above-mentioned points, and objects of the invention are to provide a plug connector housing with a locking mechanism of the above-mentioned general type, wherein the lock arms and the control arms are extended opposite one another in the depth direction on both sides in the width direction of the housing to reconcile making the plug connector and the receptacle connector thinner and more compact, making the unlocking and withdrawal operations easier and reducing the forces required for unlocking with each other. A further object of the invention is to provide a plug connector with a locking mechanism using such a plug connector housing.

The above objects have been achieved according to the invention in an electrical plug connector housing or casing for a plug connector that is adapted to be inserted into a receptacle connector. With reference to mutually perpendicular depth, width and thickness directions, the receptacle connector has a cavity opening toward the front in the depth direction, a receptacle contact provided in the cavity, and a pair of catch faces at two opposite ends of the cavity in the width direction, whereby these catch faces are oriented to face rearwardly in the depth direction.

The inventive plug connector casing comprises a housing at least partly made of an electrically insulative material and including a housing body, an inserting part that is adapted to be inserted into the cavity of the receptacle connector and that is located on a rear side of the housing body in the depth direction, and a receiving part adapted to receive a plug contact with a contacting part thereof exposed. The plug connector casing further comprises flexible lock arms and flexible control arms that are each respectively arranged on two opposite sides of the housing in the width direction, while the lock arms extend rearwardly and the control arms extend forwardly in the depth direction from respective root ends thereof. Free ends of the lock arms have protrusions extending outwardly in the width direction, which are adapted to engage behind the catch faces of the counterpart receptacle connector when the inserting part of the plug connector is inserted into the cavity of the receptacle connector. When free ends of the control arms are squeezed together inwardly in the width direction by a person's fingers, the control arms bear on the lock arms so as to deflect the lock arms inwardly in the width direction and thereby release the protrusions from the catch faces. Thereby the locked connection of the plug connector to the counterpart receptacle connector can be released.

In further more-particular embodiments, the lock arms and the control arms cross each other as seen in the thickness direction, and at least one of the lock arms or the control arms has a concave recess to allow the associated other arm to cross through. Preferably, the intermediate part of each control arm is located outwardly in the width direction relative to the intermediate part of the associated lock arm. Further preferably, the plug connector casing comprises a conductive shell arranged over an insulating member, whereby the housing and the control arms are components of the insulating member while the lock arms are components of the shell. In a preferred embodiment of a contact pattern, the plug connector casing includes a plurality of the receiving parts adapted to receive the plug contacts, whereby the receiving parts are arranged in plural positions along a single row in the width direction on a single plane normal to the thickness direction.

The above objects have further been achieved according to the invention in a plug connector that includes the inventive plug connector casing together with at least one plug contact inserted into the respective receiving part of the plug connector casing.

PREFERRED EMBODIMENT OF THE INVENTION

Figure 6:
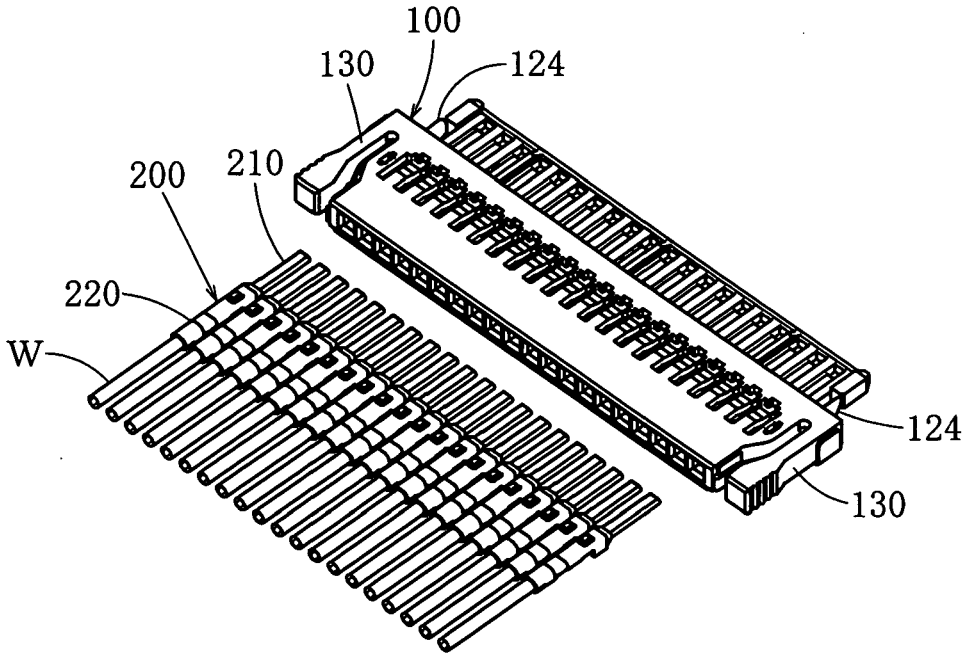
FIG. 6 is a perspective view showing the state of inserting wired contacts into the plug connector housing with locking mechanism of the embodiment.
Figure 7:
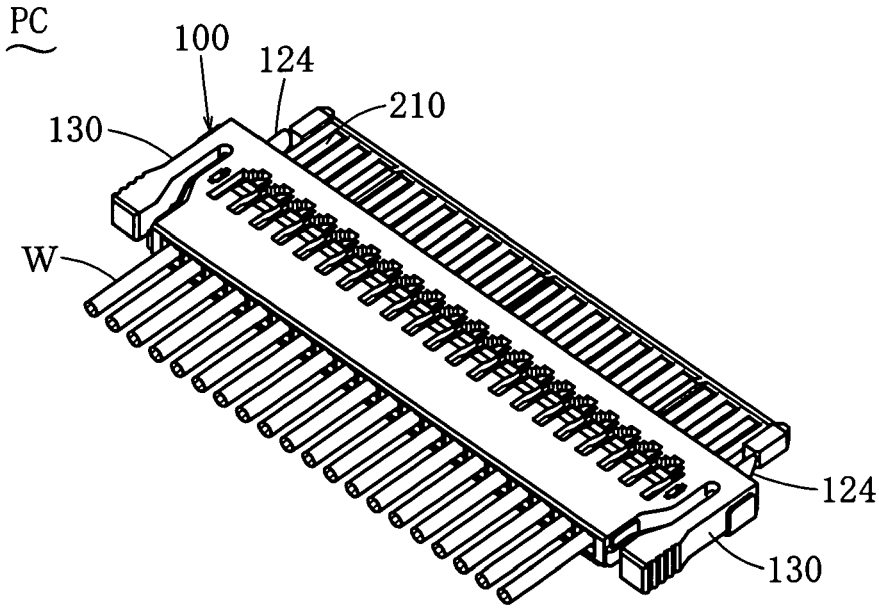
FIG. 7 is a perspective view showing the state of the plug connector housing with locking mechanism of the embodiment in which the wired contacts have been inserted or the wired plug connector with locking mechanism.
Figure 8:
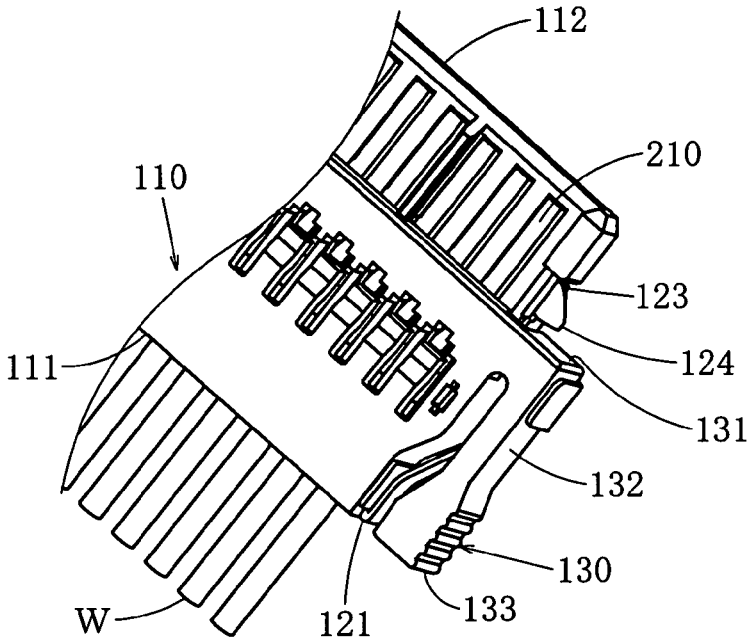
FIG. 8 is an enlarged perspective view of a part of the plug connector housing with locking mechanism of the embodiment with wired contacts having been inserted therein or the wired plug connector with locking mechanism.

In the following an embodiment of the present invention will be described. FIG. 1 through FIG. 5 show a plug connector housing with locking mechanism 100 being an embodiment of the present invention. FIG. 7 and FIG. 8 show a plug connector with locking mechanism PC comprising the plug connector housing with locking mechanism 100 and plug-connector-side contacts 200 (refer to FIG. 6) to be inserted therein. This plug connector with locking mechanism PC is to be inserted into or withdrawn from a receptacle connector RC shown in FIG. 10 through FIG. 13. In the case of this embodiment, the plug connector with locking mechanism PC is connected to electric wires W being independent discrete lines, and the receptacle connector RC is mounted on a printed circuit board B being a liquid crystal panel. The plug connector with locking mechanism according to the present invention, however, is not limited in any way by this embodiment with regard to what may be connected to it. Moreover, the receptacle connector is not limited by this embodiment in any way with regard to what may be connected to it. The plug connector with locking mechanism according to the present invention can be connected to, in addition or alternatively to discrete lines, electric wires such as coaxial lines or twisted lines of flat-type flexible cables such as flexible flat cables (FFC) or flexible printed circuits (FPC). The receptacle connector can be connected to, in addition or alternatively to printed circuit boards, for example, members having conductors.

Figure 12:
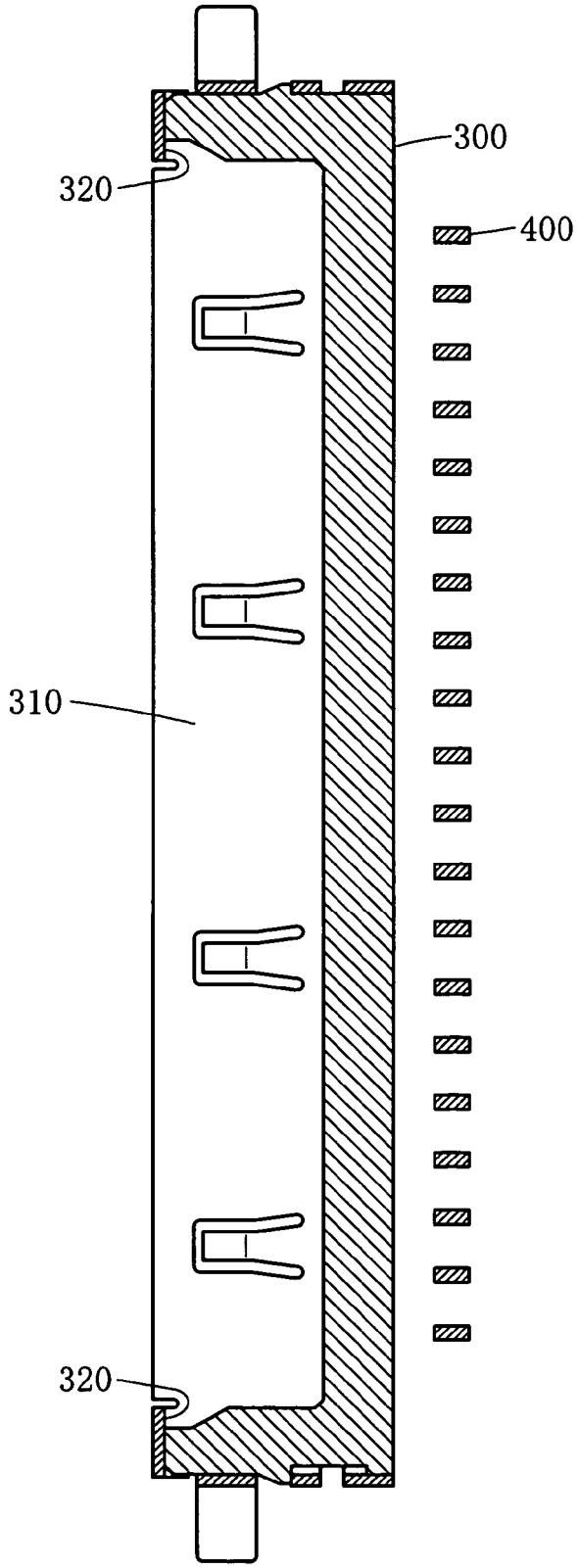
FIG. 12 is an enlarged sectional view of the receptacle connector of the embodiment seen in section in the thickness direction.
Figure 13:
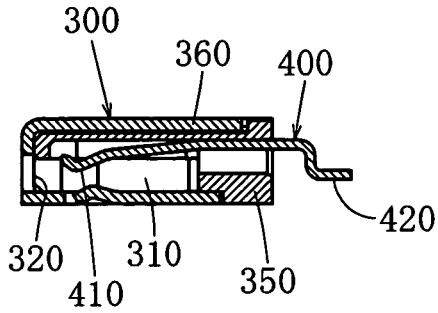
FIG. 13 is an enlarged sectional view of the receptacle connector of the embodiment seen in section in the width direction.
Figure 14:
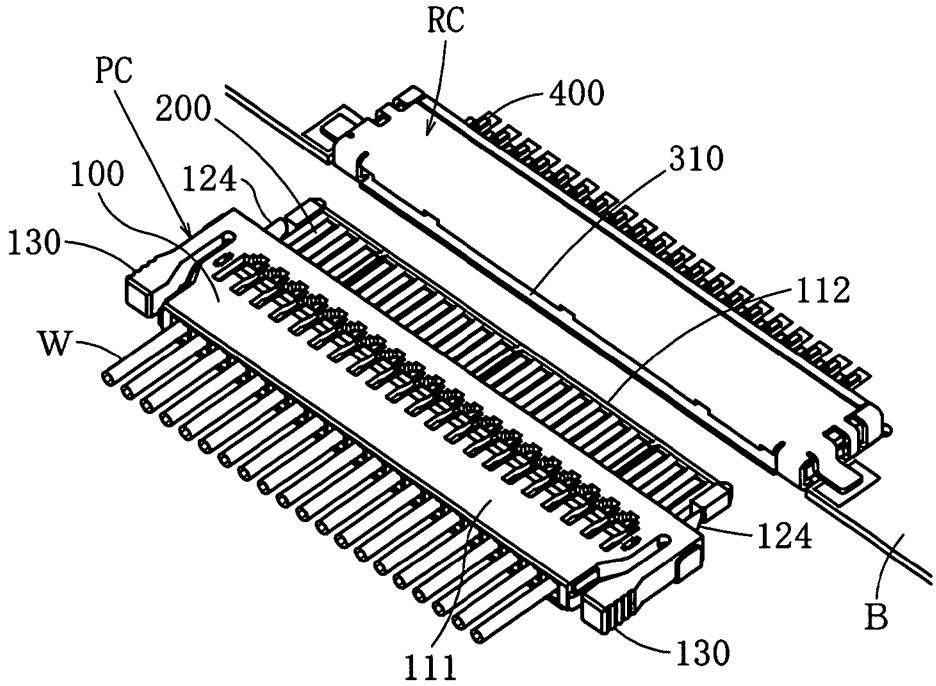
FIG. 14 is a perspective view showing the state of inserting the plug connector with locking mechanism of the embodiment into the receptacle connector.
Figure 15:
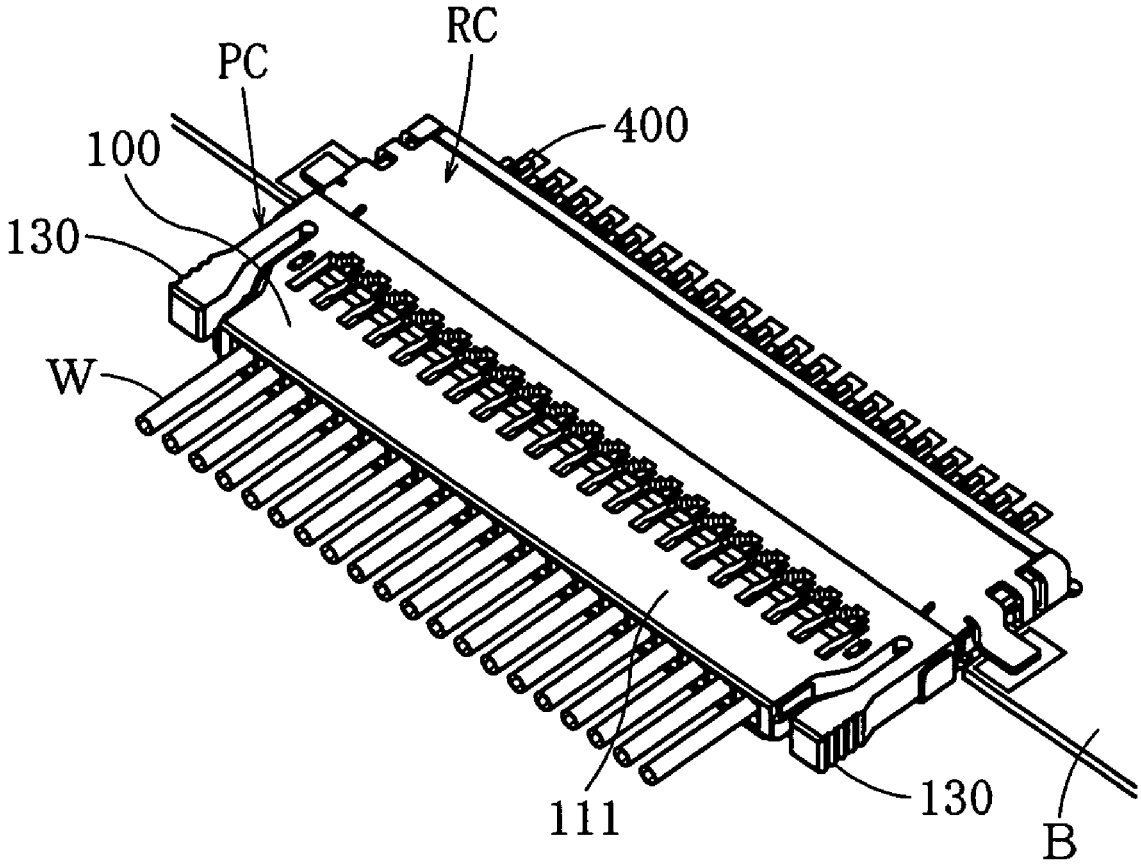
FIG. 15 is a perspective view showing the plug connector with locking mechanism of the embodiment having been inserted in the receptacle connector.
Figure 16:
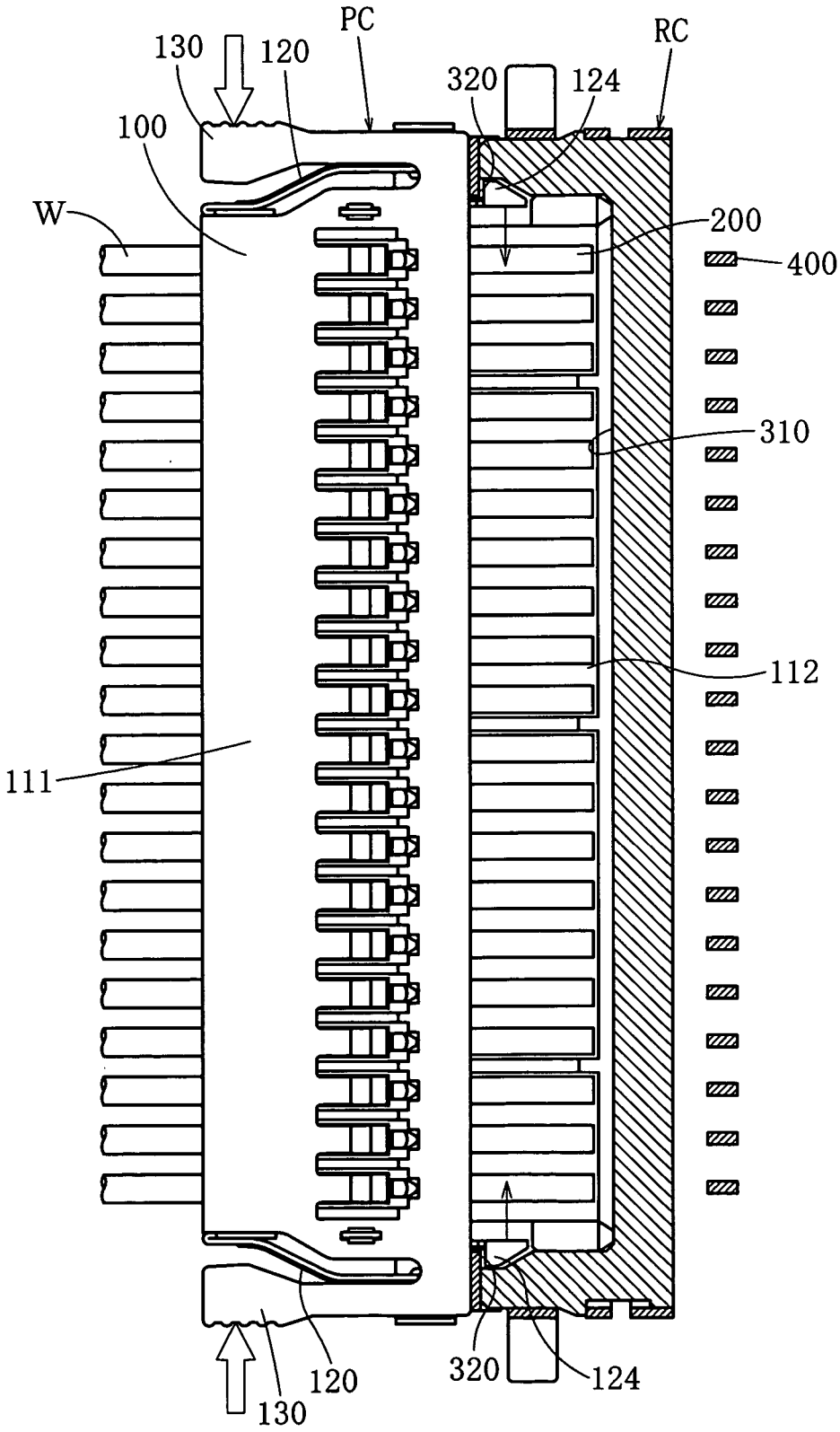
FIG. 16 is an enlarged sectional view of the receptacle connector seen in section in the thickness direction, with the plug connector with locking mechanism of the embodiment having been inserted in the receptacle connector.
Figure 17:
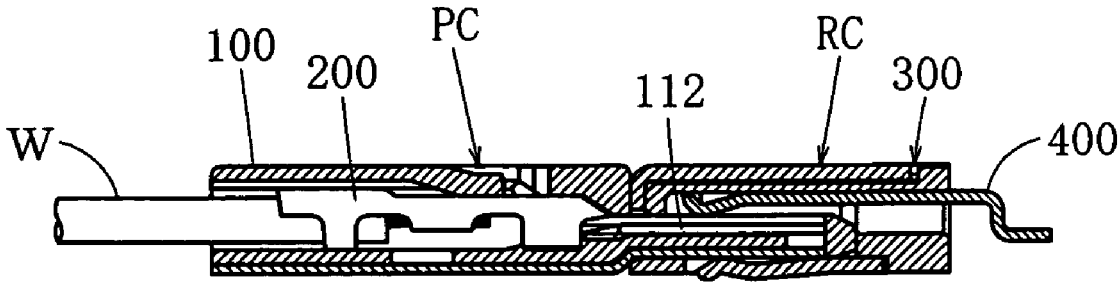
FIG. 17 is an enlarged sectional view of the plug connector with locking mechanism of the embodiment having been inserted in the receptacle connector seen in section in the width direction.

As shown in FIG. 10 through FIG. 13, the receptacle connector RC comprises the receptacle connector housing 300 and the receptacle-connector-side contacts 400. A depth direction, a width direction and a thickness direction all being perpendicular to each other are assumed and this orientation is used for description. In the case of this embodiment, with reference to FIG. 12, the left-right direction of the diagram is the depth direction, and the left of the diagram is the front side in the depth direction, and the right of the diagram is the rear side in the depth direction. The top-bottom direction of FIG. 12 is the width direction, and the direction perpendicular to the plane of the paper is the thickness direction. The receptacle connector housing 300 is provided with a cavity 310 being open frontward in the depth direction and catching faces 320 being provided on both ends in the width direction of the cavity 310 and facing rearward in the depth direction. In this embodiment small pieces facing rearward are made to protrude from both ends in the width direction of the cavity 310 inwardly in the width direction, and the rearward faces of these small pieces in the depth direction are made to serve as the catching faces 320. The inner side in the width direction is defined, when an approximately central part of the receptacle connector housing 300 is used as a reference point, as a side closer to the central part in the width direction. As for other ways of providing the catching faces, the inner faces in the width direction of both end walls in the width direction of the cavity may be concaved, and the faces facing rearward in the depth direction of the concaved parts may be used as the catching faces. Each receptacle-connector-side contact 400 is formed of a conductive member, comprises a contacting part 410, which contacts the plug-connector-side contact 200 that will be explained later, and a connecting part 420 to be connected to a printed circuit board B, and is fitted in the receptacle connector housing 300 so that the contacting part 410 is located in the cavity 310.

Figure 1:
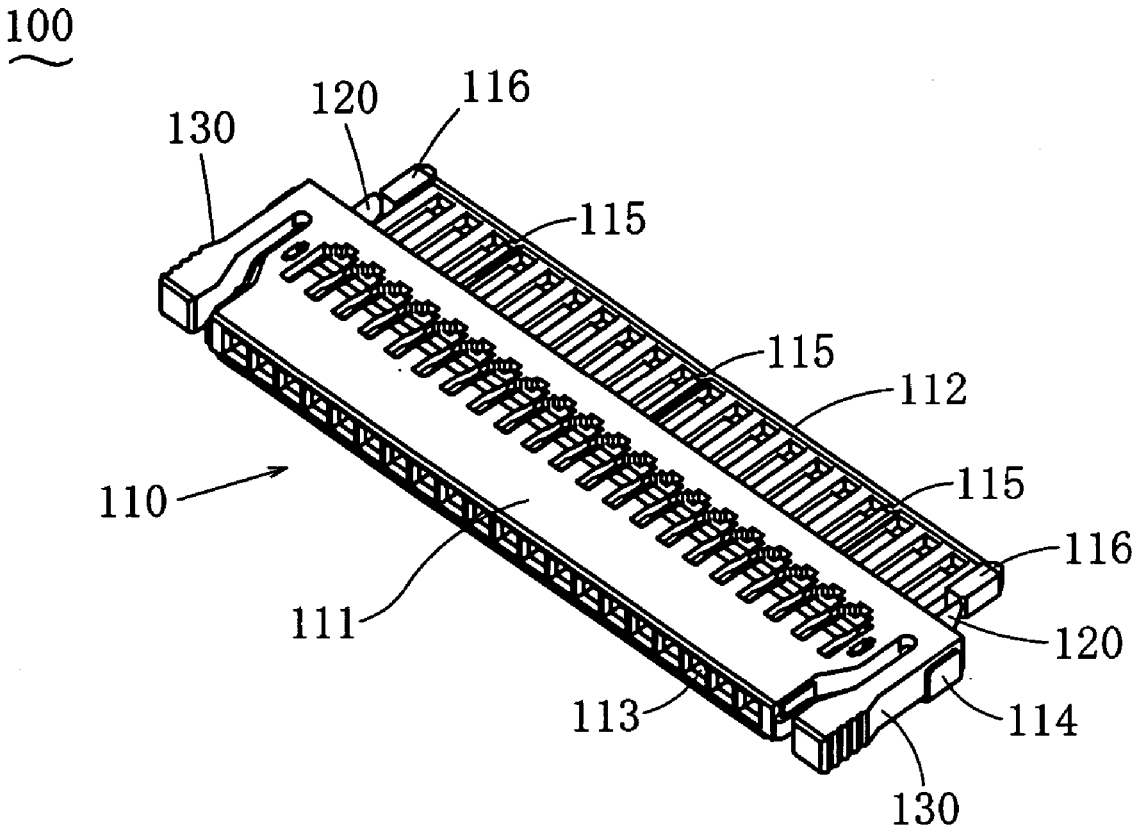
FIG. 1 is a perspective view of the plug connector housing with locking mechanism of an embodiment of the present invention.
Figure 2:
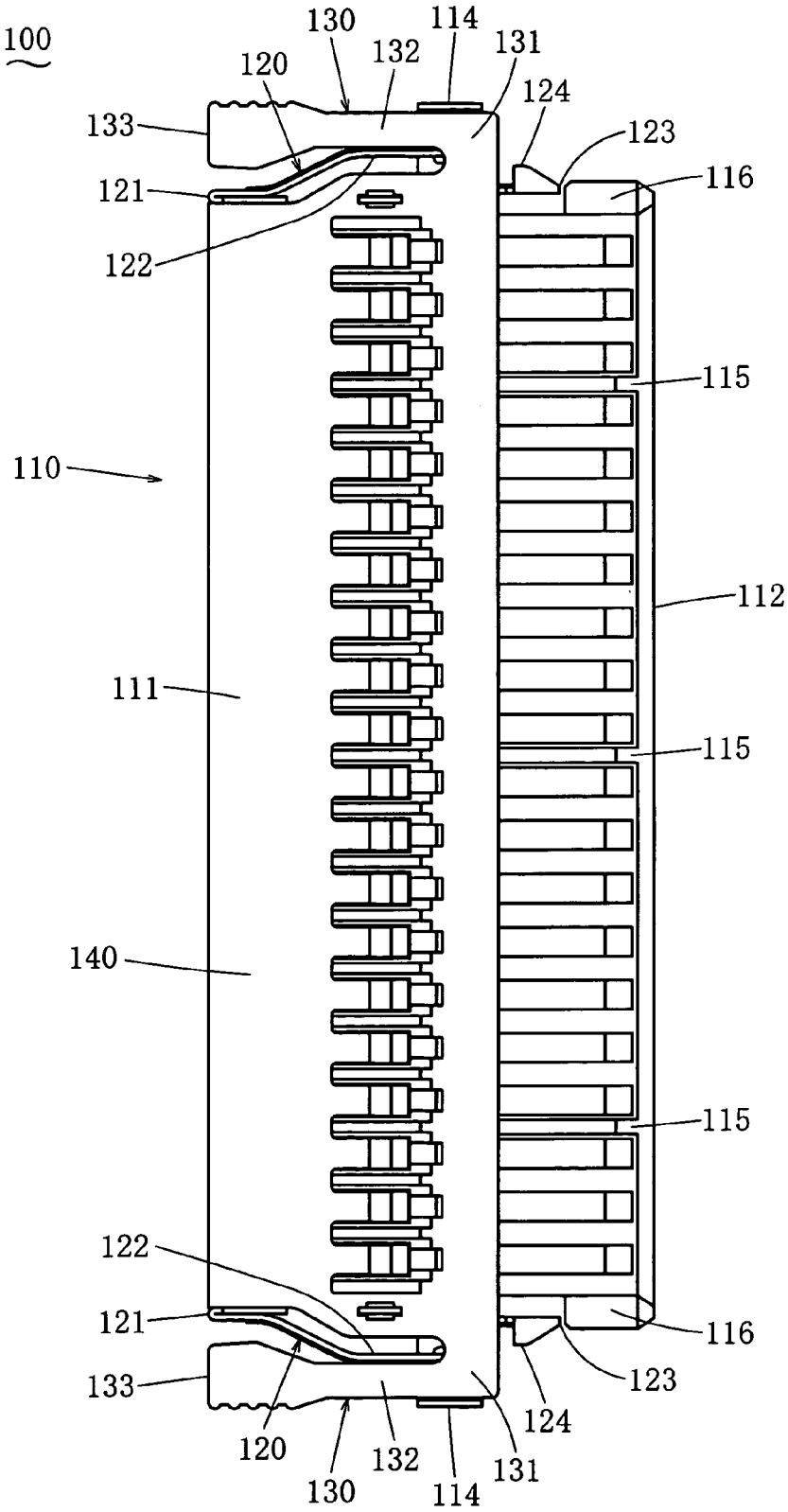
FIG. 2 is an enlarged plan view of the plug connector housing with locking mechanism of the embodiment seen in the thickness direction thereof.
Figure 3:
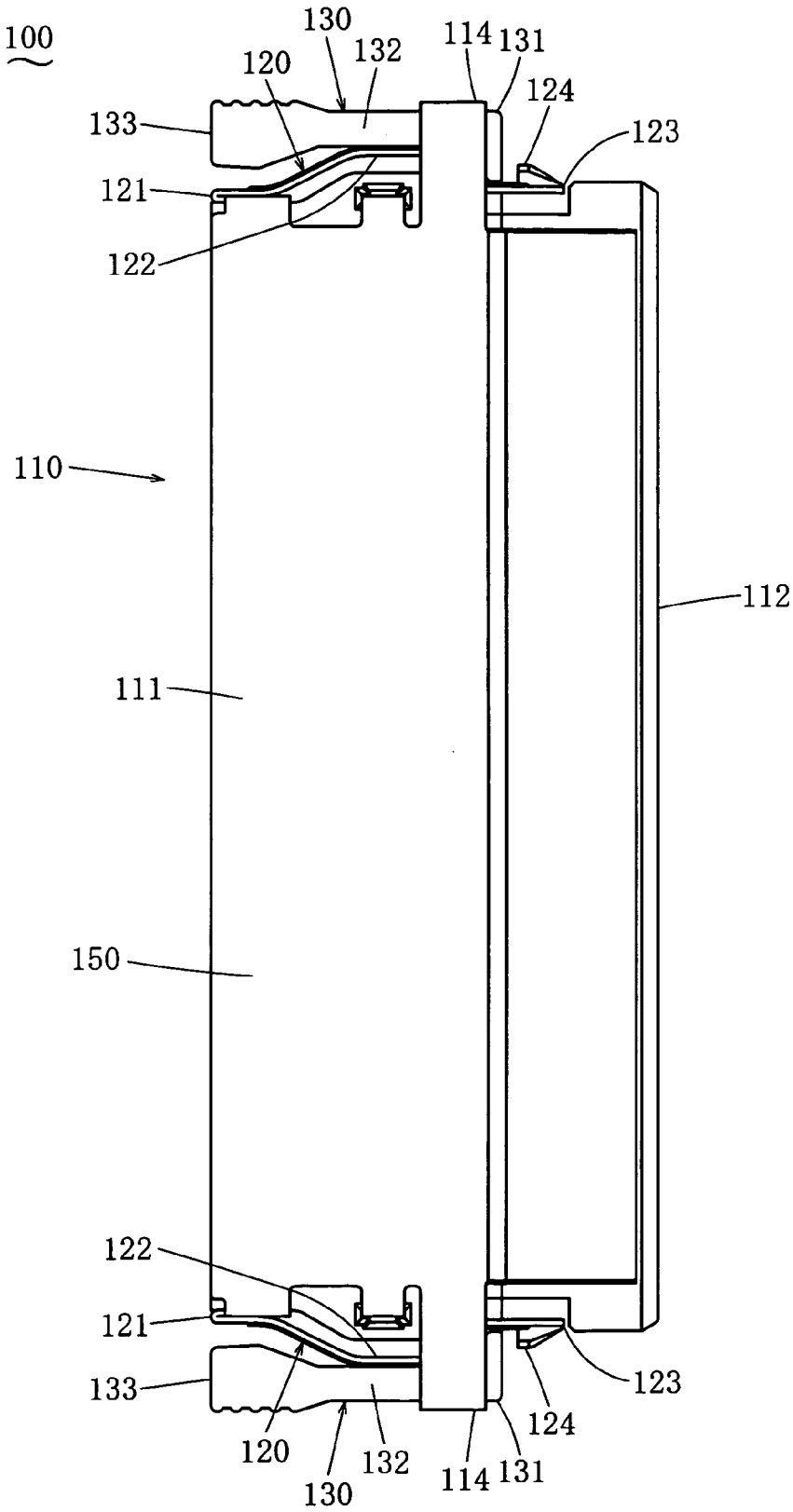
FIG. 3 is an enlarged bottom view of plug connector housing with locking mechanism of the embodiment seen oppositely in the thickness direction thereof.
Figure 4:
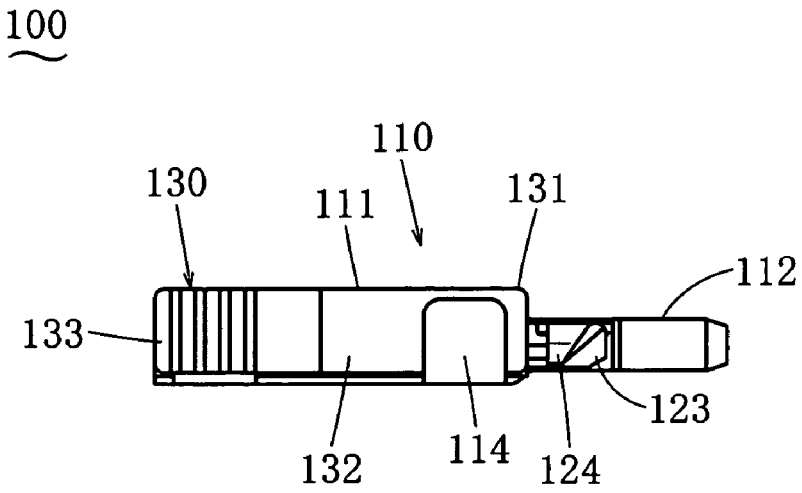
FIG. 4 is an enlarged side view of the plug connector housing with locking mechanism of the embodiment seen in the width direction thereof.
Figure 5:
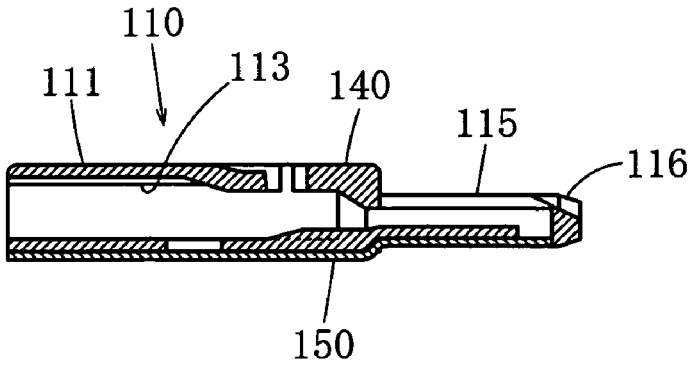
FIG. 5 is an enlarged sectional view of the plug connector housing with locking mechanism of the embodiment seen in section in the width direction thereof.

The orientation of the plug connector housing with locking mechanism 100 is similar to the orientation described above. With reference to FIG. 2, the left-right direction of the diagram is the depth direction, and the left of the diagram is the front side in the depth direction, and the right is the rear side in the depth direction. The top-bottom direction of FIG. 2 is the width direction, and the direction perpendicular to the plane of the paper is the thickness direction. As shown in FIG. 1 through FIG. 5, the plug connector housing with locking mechanism 100 comprises a housing 110, which is at least partly insulative, flexible lock arms 120 and flexible control arms 130.

The housing 110 comprises a body 111 and an inserting part 112, which is provided on the rear side in the depth direction of the body 111 and is to be inserted into the cavity 310 of the receptacle connector RC. The housing 110 is provided with receiving parts 113 for receiving the plug-connector-side contacts 200. The plug-connector-side contact 200 is formed of a conductive member and is provided with a contacting part 210, which is to contact the contacting part 410 of the receptacle-connector-side contact 400, and a connecting part 220 to be connected to an electric wire W. The plug-connector-side contact 200 is received in the receiving part 113 so that its contacting part 210 is exposed on the surface of the inserting part 112. The plug-connector-side contacts 200 are fitted in the housing 110 by using housing lance structure or contact lance structure, if necessary. In the case of this embodiment, the plug-connector-side contacts are of the crimp termination type, but they may be of the insulation displacement termination type or of a structure wherein an electric wire is connected by piercing or another method.

As shown in FIG. 1 through FIG. 4 and FIG. 6 through FIG. 9, lock arms 120 are formed into rods and are arranged on both sides in the width direction of the housing 110. The root end 121 of each lock arm 120 is fixed onto the body 111 of the housing 110 and the lock arm 120 is cantilevered. In the case of this embodiment, the root end 121 of the lock arm 120 is provided approximately at the frontward end in the depth direction of the body 111, but the position of the root end 121 is not limited in any way to it. Each lock arm 120 extends rearward in the depth direction up to the outer sides in the width direction of the inserting part 112. A protrusion 124 protruding outwardly in the width direction is provided on the top end 123 of each lock arm 120. The outer side in the width direction means, when an approximately central part of the housing 110 is used as the reference, the remoter side from the central part in the width direction. The inner side in the width direction means the closer side to the central part in the width direction.

As shown in FIG. 1 through FIG. 4 and in FIG. 6 through FIG. 9, the control arms 130 are formed into rods and are arranged on both sides in the width direction of the housing 110. Each control arm 130 is cantilevered with its root end 131 being fixed on the body 111 of the housing 110 at a point deeper in the depth direction than the root end 121 of the lock arm 120. In the case of the present embodiment, the root end 131 of the control arm 130 is provided approximately at the rearward end in the depth direction of the body 111. The position of the root end 131, however, is not limited to this in any way. Each control arm 130 extends frontward in the depth direction. In the case of this embodiment, the top end 133 of the control arm 130 extends approximately up to the frontward end in the depth direction of the body 111. The position of the top end 133, however, is not limited to this point in any way. Each control arm 130 is arranged so that its intermediate part 132 transmits a force working inwardly in the width direction to the intermediate part 122 of the lock arm 120.

With the arrangement described above, when the inserting part 112 of the housing 110 is inserted into the cavity 310 of the receptacle connector RC, the protrusions 124 of the lock arms 120 will be caught on the catching faces 320 of the receptacle connector RC. And when the top ends 133 of the control arms 130 are pushed inward in the width direction, the protrusions 124 of the lock arms 120 will be displaced inward in the width direction and released from the catching faces 320 of the receptacle connector RC (refer to FIG. 14 through FIG. 17).

The housing 110 is provided as an approximately rectangular form having two sides extending in the depth direction and the width direction when seen in the thickness direction. It is preferable to form the rearward end in the depth direction of the housing 110 into a wedge shape getting thinner towards the top end when seen in the width direction. With this arrangement, it is easier to insert the plug connector with locking mechanism PC into the receptacle connector RC. The shape of the housing 110, however, is not limited in any way by this embodiment.

Figure 9:
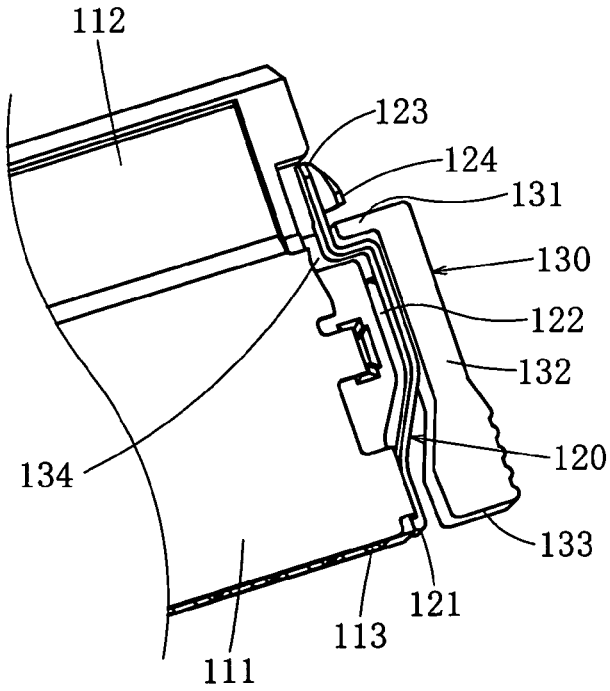
FIG. 9 is an enlarged perspective view showing the plug connector housing with locking mechanism of the embodiment from which a part extending from the shell to one side end wall is cut away.
Figure 10:
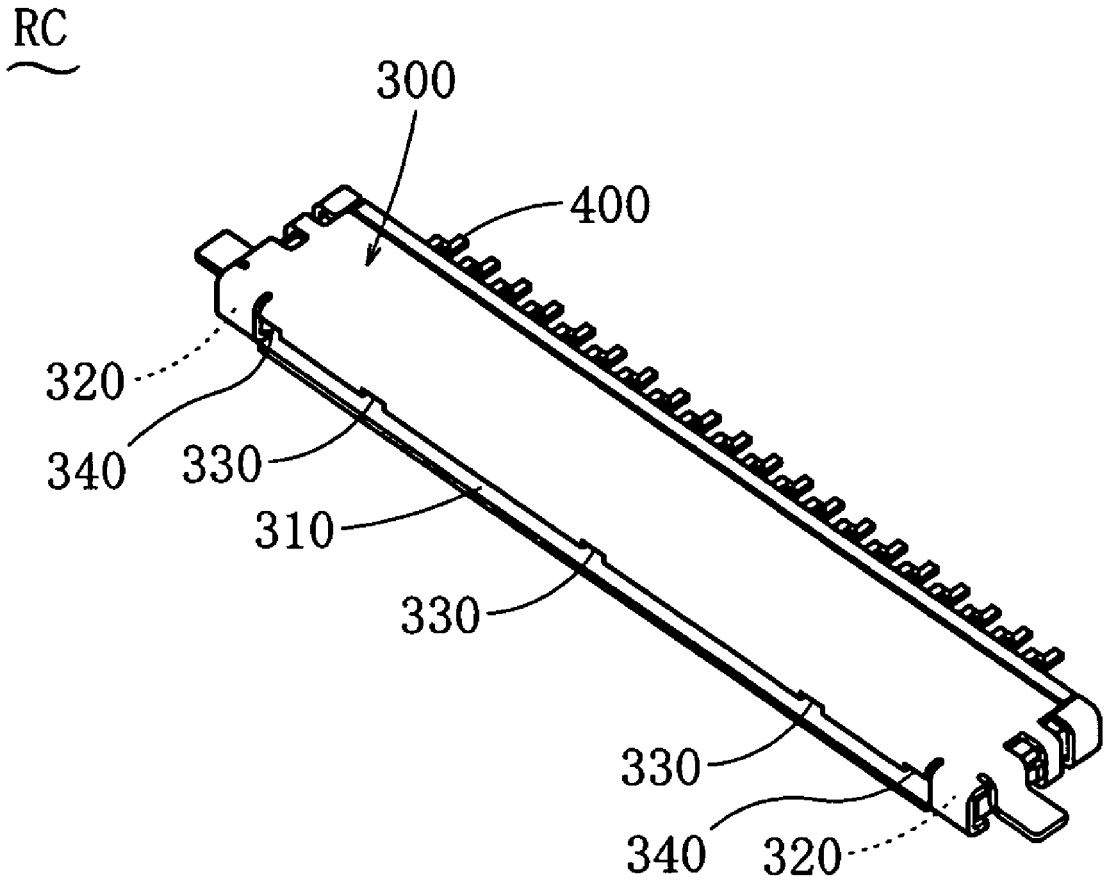
FIG. 10 is a perspective view of the receptacle connector of the embodiment.
Figure 11:
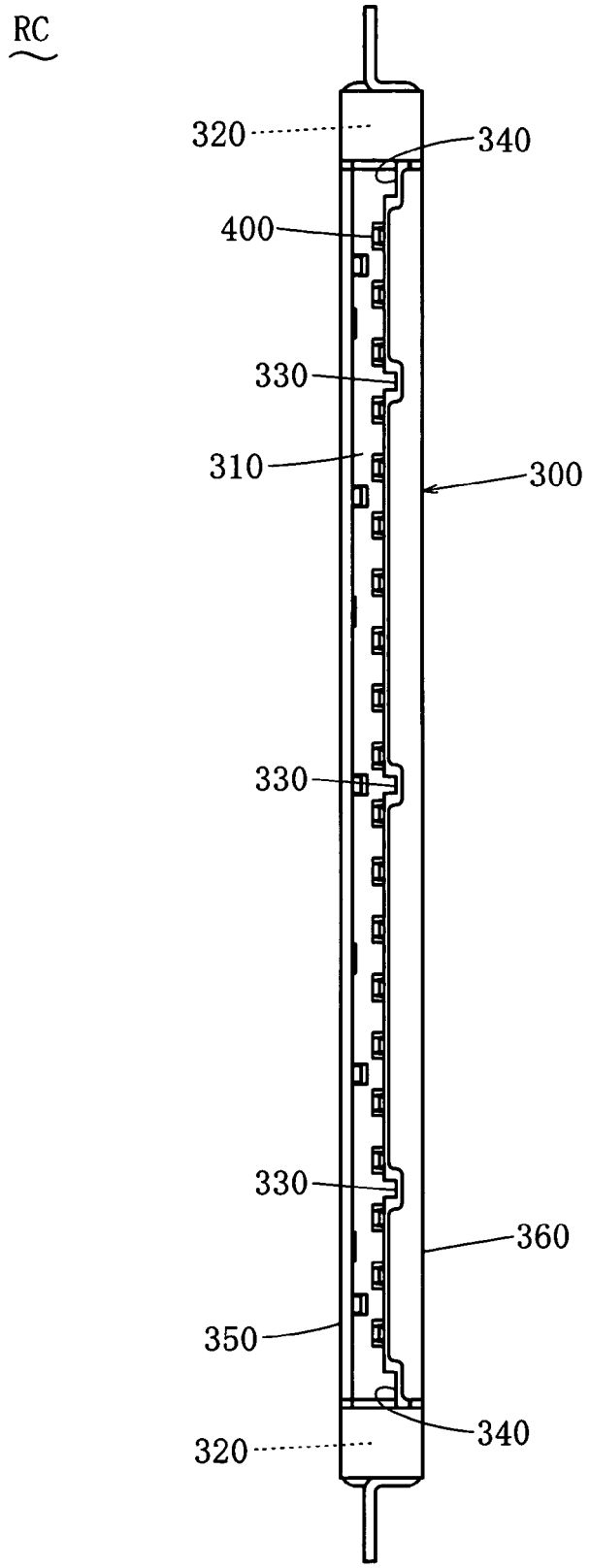
FIG. 11 is an enlarged front view of the receptacle connector of the embodiment seen from the front side in the depth direction.

As shown in FIG. 9, the lock arm 120 and the control arm 130 cross each other when seen in the thickness direction. At least, either the lock arm 120 or the control arm 130 is provided with an avoiding part that is concaved in the thickness direction to avoid interference with the counterpart arm. In the case of this embodiment, the control arm 130 is provided with an avoiding part 134 in the form of a groove concaving on one side thereof in the thickness direction. A portion in the longitudinal direction of the lock arm 120 is received in this avoiding part 134. The dimension in the width direction of the avoiding part 134 is set greater than the width of the portion of the lock arm 120 being received therein, enabling the lock arm 120 to be displaced in the width direction. The avoiding part may be provided in the lock arm or in both the lock arm and the control arm.

As shown in FIG. 9, the intermediate part 132 of the control arm 130 is located on the outer side in the width direction of the intermediate part 122 of the lock arm 120, and the intermediate part 132 of the control arm 130 is arranged to press the intermediate part 122 of the lock arm 120 on the outer side thereof in the width direction to transmit a force working inward in the width direction.

As shown in FIG. 1 through FIG. 9, the plug connector housing with locking mechanism 100 comprises the insulating member 140 being insulative and the shell 150 being conductive and being put over the insulating member 140. The housing 110 and the control arms 130 are formed by the insulating member 140. The lock arms 120 are formed by some portions of the shell 150. In the case of this embodiment, the receptacle connector housing 300 also comprises an insulating member 350 being insulative and a shell 360 being conductive and being put over the insulating member 350. Both housings are arranged in such a way that when the plug connector with locking mechanism PC is inserted into the receptacle connector RC, both shells thereof will contact with each other. In that case, if the shell 360 of the receptacle connector housing 300 is connected to the grounding pattern of the printed circuit board B, the shielding effects of both connectors PC and RC will be enhanced. The present invention includes embodiments wherein the receptacle connector housing 300 does not comprise such two members.

If the plug connector housing with locking mechanism 100 comprises the insulating member 140 and the shell 150 having a greater strength than that of the insulating member 140, the strength of the control arms 130 can be increased or the control arms 130 can be prevented from excessive deformation by providing the shell 150 with side end walls 114 rising along the outer faces in the width direction of the control arms 130. The present invention includes embodiments wherein no side end wall 114 is provided.

Contacts 200, 400 are arranged in one row in the width direction and in one stage in the thickness direction in both the plug connector with locking mechanism PC and the receptacle connector RC. Hence, as shown in FIG. 1 through FIG. 9, the receiving parts 113 are arranged in one stage in the thickness direction and in a plurality of rows in the width direction in the housing 110.

The plug connector housing with locking mechanism 100 is provided with first restricting parts 115 for preventing prying, and in correspondence to them, the receptacle connector housing 300 is provided with first restricting parts 330. In other words, ribs 115 being the first restricting parts extending in the depth direction are provided on the inserting part 112 of the plug connector housing with locking mechanism 100 at appropriate locations in the width direction thereof, and grooves 330 being the counterpart first restricting parts for receiving the above-mentioned ribs 115 are provided in the receptacle connector housing 300. With this provision of the first restricting parts 115, 330, for example, when the plug connector with locking mechanism PC is inserted into the receptacle connector RC at an angle seen in the thickness direction rather than straight in the depth direction, the first restricting parts 115, 330 will not fit together properly, preventing the insertion. In this way, prying can be prevented. The inserting part 112 of the plug connector housing with locking mechanism 100 may be provided with grooves as the first restricting parts, and the receptacle connector housing 300 with ribs as the first restricting parts. The present invention includes embodiments wherein the first restricting parts 115, 330 are not provided.

The plug connector housing with locking mechanism 100 is provided with second restricting parts 116 for preventing reverse insertion, and in correspondence with this, the receptacle connector housing 300 is provided with second restricting parts 340. In other words, the inserting part 112 of the plug connector housing with locking mechanism 100 is provided with ribs 116 rising on one side in the thickness direction as the second restricting parts, and in correspondence to it, the receptacle connector housing 300 is provided with grooves 340 for receiving the above-mentioned ribs 116 as the counterpart second restricting parts. In the case of this embodiment, the second restricting parts 116, 340 are provided on both ends in the width direction of the plug connector housing with locking mechanism 100 and the receptacle connector housing 300. The locations of the second restricting parts, however, are not limited in any way by this embodiment. With the provision of the second restricting parts 116, 340, when, for example, one reverses the plug connector with locking mechanism PC in the thickness direction from its regular position and attempts to insert it into the receptacle connector RC, the plug connector PC can not be inserted because the second restricting parts 116, 340 can not fit together. This prevents reverse insertion. A variety of pairs of a plug connector with locking mechanism PC and a receptacle connector RC may be set to have different numbers of poles. When a plug connector with locking mechanism PC and a receptacle connector RC, of which numbers of poles differ from each other, are attempted to be connected together, their second restricting parts 116, 340 can not be fitted together and in turn these connectors can not be connected up. The inserting part 112 of the plug connector housing with locking mechanism 100 may be provided with grooves as the second restricting parts, and the receptacle connector housing 300 may be provided with ribs as the second restricting parts. The present invention includes embodiments wherein the second restricting parts 116, 340 are not provided.

When the plug-connector-side contacts 200 are set in the receiving parts 113 of this plug connector housing with locking mechanism 100 to form the plug connector with locking mechanism PC, and this plug connector is inserted into the receptacle connector RC so that the inserting part 112 is inserted into the cavity 310, thereby the lock arms 120 will be flexed, and the protrusions 124 of the lock arms 120 will be displaced inwardly in the width direction and will then return. As a result, the protrusions 124 will be caught on the catching faces 320 of the receptacle connector RC. This, in turn, will lock the plug connector with locking mechanism PC to the receptacle connector RC. When the top ends 133 of the control arms 130 are pressed inwardly in the width direction (the direction indicated by the thicker arrows in FIG. 16) by one's fingers, the forces will be transmitted from the intermediate parts 132 of the control arms 130 to the intermediate parts 122 of the lock arms 120, the lock arms 120 will be flexed, and the protrusions 124 will be displaced inwardly in the width direction (the direction indicated by the narrow arrows in FIG. 16) to be released from the catching faces of the receptacle connector RC. This, in turn, unlocks the plug connector with locking mechanism PC from the receptacle connector RC, enabling the plug connector with locking mechanism PC to be withdrawn from the receptacle connector RC. It should be noted that the control arms 130 and the lock arms 120 contact with each other by their intermediate parts 122, 132. Strictly speaking, however, the locations of such contacts shift a little in response to the displacements of the intermediate parts 122, 132.

In that case, as the lock arms 120 and the control arms 130 are located on both sides in the width direction of the housing 110 and these arms are flexed in the width direction, the plug connector with locking mechanism PC and the receptacle connector RC can be reduced in thickness. As the intermediate part 132 of the control arm 130 transmits the force to the intermediate part 122 of the lock arm 120, the intermediate part 132 serves as the point of action for the force working from the control arm 130 to the lock arm 120 and the control arm 130 extends more from the intermediate part 132 frontward or forwardly in the depth direction, it is sufficient to apply a smaller force to the top end of the control arm 130 by one's finger because of the principle of leverage. Thus the force required for unlocking can be reduced. As the control arm 130 extends frontward in the depth direction, the top end 133 of the control arm 130 can be spaced as much as possible, frontward in the depth direction, from the receptacle connector RC. Accordingly, even when the receptacle connector RC is mounted in a narrow space leaving tight work space, it is easy to undo the locking by pressing the control arms 130 by one's fingers. As the lengths of the lock arm 120 and the control arm 130 are not extended to excessively exceed the length of the housing 110 in the depth direction, the plug connector with locking mechanism PC and the receptacle connector RC can be made more compact.

The present invention includes embodiments wherein the lock arm and the control arm are arranged parallel to each other when seen in the thickness direction and embodiments wherein the lock arm and the control arm overlap with each other when seen in the thickness direction. Of these embodiments, in the case of the above-mentioned embodiment, the lock arm 120 and the control arm 130 cross with each other when seen in the thickness direction, and at least either the lock arm 120 or the control arm 130 is provided with an avoiding part 134 being concaved in the thickness direction to avoid interference with the other arm. With this arrangement, the plug connector with locking mechanism PC and the receptacle connector RC can be reduced further in thickness.

The present invention includes all embodiments wherein the intermediate part of the control arm is arranged to transmit a force working inwardly in the width direction to the intermediate part of the lock arm. Accordingly, the present invention does not limit the relative positional relationship between the lock arm and the control arm. The present invention also include's embodiments wherein the intermediate part of the control arm is arranged to catch the intermediate part of the lock arm and push or pull it inwardly in the width direction when the former is displaced inwardly in the width direction. Among these embodiments, in the case of the above-mentioned embodiment, the intermediate part 132 of the control arm 130 is located on the outer side in the width direction of the intermediate part 122 of the lock arm 120, and the intermediate part 132 of the control arm 130 is arranged to contact the intermediate part 122 of the lock arm 120 from the outer side in the width direction to transmit the force working inwardly in the width direction. With this arrangement, as the force is transmitted from the intermediate part 132 of the control arm 130 to the intermediate part 122 of the lock arm 120 by a simple structure, it is easy to produce the plug connector housing with locking mechanism 100.

The present invention includes embodiments wherein the housing is entirely made of an insulative material. Among them, in the case of the above-mentioned embodiment, the plug connector housing with locking mechanism 100 comprises the insulating member 140 being insulative and the shell 150 being put over the insulating member 140 and being conductive, the housing 110 and control arms 130 are formed of the insulating member 140, and the lock arms 120 are formed of some portions of the shell 150. With this arrangement, the shielding performance of the plug connector with locking mechanism PC is enhanced by the shell 150. When the shell 150 is formed of a material of which strength is higher than that of the insulating member 140, the strength of the lock arms will be enhanced. As an example, embodiments wherein the shell 150 is formed of a metal may be proposed.

The present invention does not limit the number of contacts and their arrangement. Among them, in the case of the above-mentioned embodiment, the contacts 200, 400 are arranged in one row in the width direction and in one stage in the thickness direction in the plug connector with locking mechanism PC and the receptacle connector RC. Accordingly, the receiving parts 113 are arranged in one stage in the thickness direction and in a plurality of rows in the width direction in the housing 110. With this arrangement, the plug connector with locking mechanism PC and the receptacle connector RC can be reduced in thickness effectively.

In the above-mentioned embodiment electric wires W are connected to the plug connector with locking mechanism PC. If a flat-type flexible cable is to be connected, the connecting parts of the plug-connector-side contacts are arranged to connect the flat-type flexible cable. In this case, for example, the connecting parts may be provided with protrusions for piercing.

With the description of these embodiments the first plug connector housing with locking mechanism and the first plug connector with locking mechanism that were explained in Summary of the Invention above have been described fully. Moreover, with the description of these embodiments the second through fifth plug connector housings with locking mechanism and the second plug connector with locking mechanism comprising the plug connector housing with locking mechanism, which are to be explained below, have been described fully.

The second plug connector housing with locking mechanism is the first plug connector housing with locking mechanism wherein the lock arms and the control arms cross with each other seen in the thickness direction, and at least either the lock arm or the control arm is provided with an avoiding part being concaved in the thickness direction to avoid interference with the other.

With this arrangement, the plug connector with locking mechanism and the receptacle connector can be reduced further in the thickness.

The third plug connector housing with locking mechanism is the first or the second plug connector housing with locking mechanism wherein the intermediate part of the control arm is located on the outer side in the width direction of the intermediate part of the lock arm, and the intermediate part of the control arm is arranged to transmit a force working inwardly in the width direction to the intermediate part of the lock arm by contacting the intermediate part of the lock arm from the outer side in the width direction.

With this arrangement, as the force is transmitted from the intermediate part of the control arm to the intermediate part of the lock arm by a simple structure, it is easy to produce the plug connector housing with locking mechanism.

The fourth plug connector housing with locking mechanism is any one of the first through third plug connector housings with locking mechanism wherein the plug connector housing comprises an insulating member being insulative and a shell being conductive and being put over the insulating member, and the housing and the control arms are formed of the insulating member, and the lock arms are formed of some portions of the shell.

With this arrangement, the shielding performance of the plug connector with locking mechanism is enhanced by the shell. If the shell is formed of a material of which strength is greater than that of the insulating member, the strength of the lock arms will be enhanced.

The fifth plug connector housing with locking mechanism is any one of the first through fourth plug connector housings with locking mechanism wherein the receiving parts are arranged in one stage in the thickness direction and in a plurality of rows in the width direction in the housing.

With this arrangement, the plug connector with locking mechanism and the receptacle connector can be reduced in thickness effectively.

The second plug connector with locking mechanism according to the present invention comprises any one of the second through fifth plug connector housings with locking mechanism and the plug-connector-side contact inserted in the receiving part of the plug connector housing with locking mechanism.

In the plug connector with locking mechanism according to the present invention the lock arms and the control arms are extended oppositely in the depth direction on both sides in the width direction of the housing. As a result, the present invention has successfully provided a plug connector with locking mechanism wherein making the plug connector with locking mechanism and the receptacle connector thinner and more compact, making the unlocking and withdrawal operations easier and reducing the forces required for unlocking are made compatible with each other.

The plug connector housing or casing with a locking mechanism according to the present invention is a plug connector housing with locking mechanism constituting, together with a plug-connector-side contact, a plug connector with locking mechanism to be inserted into or withdrawn from a receptacle connector having, with reference to a depth direction, a width direction and a thickness direction being perpendicular to each other, a cavity opening frontward i.e. forwardly in the depth direction, catching faces being provided at both ends in the width direction of the cavity and facing rearward in the depth direction, and a receptacle-connector side contact provided in the cavity. The plug connector housing or casing comprises a housing having a body, an inserting part being provided on the rear side in the depth direction of the body and being adapted to be inserted into the cavity of the receptacle connector, a receiving part to receive the plug-connector side contact so that a contacting part thereof is exposed on the surface of the inserting part, the housing being at least partly insulative, flexible lock arms being arranged on both sides in the width direction of the housing, of which root ends are provided on the body of the housing, the lock arms extending rearward in the depth direction and up to the outer sides in the width direction of the inserting part and having protrusions, at the top ends thereof, extending outward in the width direction, and flexible control arms being arranged on both sides in the width direction of the housing, of which root ends are provided on the body of the housing on the rear side in the depth direction of the root ends of the lock arms, the control arms extending frontward in the depth direction, and the intermediate parts thereof being arranged to transmit forces working inwardly in the width direction to the intermediate parts of the lock arms, and being arranged in such a way that when the inserting part of the housing is inserted into the cavity of the receptacle connector, the protrusions of the lock arms will be caught on the catching faces of the receptacle connector, and when the top ends of the control arms are pressed inwardly in the width direction, the protrusions of the lock arms will be displaced inwardly in the width direction to be released from the catching faces of the receptacle connector.

When the plug-connector-side contact is set in the receiving part of this plug connector housing to form the plug connector with locking mechanism, and this plug connector is inserted into the receptacle connector so that the inserting part is inserted into the cavity, thereby the lock arms will be flexed, the protrusions of the lock arms will be displaced inwardly in the width direction and will return, and in turn, the protrusions will be hooked on the catching faces of the receptacle connector. This, in turn, will lock the plug connector to the receptacle connector. When the top ends of the control arms are pressed inwardly in the width direction by on&s fingers, the forces will be transmitted from the intermediate parts of the control arms to the intermediate parts of the lock arms, the lock arms will be flexed, the protrusions will be displaced inwardly in the width direction to be released from the catching faces of the receptacle connector. As a result, the plug connector will be unlocked from the receptacle connector, enabling the plug connector to be withdrawn from the receptacle connector.

In that case, as the lock arms and the control arms are located on both sides in the width direction of the housing and these arms are flexed in the width direction, the plug connector and the receptacle connector can be reduced in thickness. As the intermediate part of the control arm transmits the force to the intermediate part of the lock arm, the latter intermediate part serves as the point of action for the force working from the control arm to the lock arm, and the control arm extends further more from the intermediate part frontward in the depth direction, it is sufficient to apply a smaller force to the top end of the control arm by one's finger because of the principle of leverage. Thus the force required for unlocking can be reduced. As the control arm extends frontward in the depth direction, the top end of the control arm can be spaced as much as possible, frontward in the depth direction, from the receptacle connector. Accordingly, even when the receptacle connector is mounted in a narrow space leaving tight work space, it is easy to undo the locking by pressing the control arms with one's fingers. As the lengths of the lock arm and the control arm are not extended to excessively exceed the length of the housing in the depth direction, the plug connector and the receptacle connector can be made more compact.

In the plug connector housing according to the present invention, the lock arms and the control arms are extended oppositely in the depth direction on both sides in the width direction of the housing. As a result, the present invention has successfully provided a plug connector housing with locking mechanism wherein it has become possible simultaneously to make the plug connector and the receptacle connector thinner and more compact, to make the unlocking and withdrawal operations easier, and to reduce the forces required for unlocking the locking mechanism.

The plug connector with locking mechanism according to the present invention comprises the inventive plug connector housing the plug-connector-side contact inserted in the receiving part of the plug connector housing. In the plug connector according to the present invention, the lock arms and the control arms are extended oppositely in the depth direction on both sides in the width direction of the housing. As a result, the present invention has successfully provided a plug connector with locking mechanism wherein it has become possible simultaneously to make the plug connector and the receptacle connector thinner and more compact, to make the unlocking and withdrawal operations easier, and to reduce the forces required for unlocking the locking mechanism.

What is claimed is:

1. A plug connector casing for a plug connector adapted to be inserted into or withdrawn from a receptacle connector, wherein, with reference to a depth direction, a width direction and a thickness direction being perpendicular to each other, the receptacle connector has a cavity opening frontward in the depth direction, catching faces provided at two opposite ends in the width direction of the cavity and facing rearward in the depth direction, and a receptacle contact provided in the cavity, wherein the plug connector casing comprises:

a housing having a body, an inserting part provided on a rear side in the depth direction of the body and being adapted to be inserted into the cavity of the receptacle connector, a receiving part adapted to receive a plug contact so that a contacting part thereof is exposed on a surface of the inserting part, wherein at least a part of the housing is insulative, flexible lock arms arranged on two opposite sides in the width direction of the housing, wherein the lock arms have root ends thereof provided on the body of the housing, the lock arms extend rearward in the depth direction and toward outer sides in the width direction of the inserting part, and the lock arms have protrusions extending outward in the width direction at top ends of the lock arms, and flexible control arms arranged on the two opposite sides in the width direction of the housing, wherein the control arms have root ends thereof provided on the body of the housing at locations rearward in the depth direction relative to the root ends of the lock arms, the control arms extend frontward in the depth direction from the root ends of the control arms via intermediate parts thereof to top ends thereof, and the intermediate parts of the control arms are arranged to transmit forces working inwardly in the width direction onto the intermediate parts of the lock arms, and wherein the plug connector casing is configured, arranged and adapted in such a way that the inserting part of the housing is adapted to be inserted into the cavity of the receptacle connector such that the protrusions of the lock arms will be caught on the catching faces of the receptacle connector, and the top ends of the control arms are adapted to be pressed inwardly in the width direction such that the intermediate parts of the control arms transmit the forces working inwardly in the width direction onto the intermediate parts of the lock arms so that the protrusions of the locks arms will be displaced inwardly in the width direction to be released from the catching faces of the receptacle connector.

2. The plug connector casing of claim 1, comprising a plurality of the receiving parts arranged on one plane normal to the thickness direction and in a plurality of positions along a single row in the width direction in the housing.

3. A plug connector comprising the plug connector casing of claim 1 and the plug contact inserted in the receiving part of the plug connector casing.

4. The plug connector casing of claim 1, wherein the lock arms and the control arms cross each other as seen in the thickness direction, and at least one of the lock arms or one of the control arms is provided with an avoiding part having a concave recess in the thickness direction to avoid interference with an associated crossing one of the control arms or the lock arms.

5. The plug connector casing of claim 4, comprising a plurality of the receiving parts arranged on one plane normal to the thickness direction and in a plurality of positions along a single row in the width direction in the housing.

6. A plug connector with comprising the plug connector casing of claim 4 and the plug contact inserted in the receiving part of the plug connector casing.

7. The plug connector casing of claim 1, wherein the intermediate part of each said control arm is located outwardly in the width direction relative to the intermediate part of a respective associated one of the lock arms, and the intermediate part of each said control arm is arranged to transmit the forces working inwardly in the width direction onto the intermediate part of the respective associated one of the lock arms by contacting the intermediate part of the respective associated lock arm from an outer side thereof in the width direction.

8. The plug connector casing of claim 7, comprising a plurality of the receiving parts arranged on one plane normal to the thickness direction and in a plurality of positions along a single row in the width direction in the housing.

9. A plug connector comprising the plug connector casing of claim 7 and the plug contact inserted in the receiving part of the plug connector casing.

10. The plug connector casing of claim 4, wherein the intermediate part of each said control arm is located outwardly in the width direction relative to the intermediate part of a respective associated one of the lock arms, and the intermediate part of each said control arm is arranged to transmit the forces working inwardly in the width direction onto the intermediate part of the respective associated one of the lock arms by contacting the intermediate part of the respective associated lock arm from an outer side thereof in the width direction.

11. The plug connector casing of claim 10, comprising a plurality of the receiving parts arranged on one plane normal to the thickness direction and in a plurality of positions along a single row in the width direction in the housing.

12. The plug connector casing of claim 1, wherein the plug connector casing comprises an electrically insulative insulating member and an electrically conductive shell that is put over the insulating member, the housing and the control arms are formed of the insulating member, and the lock arms are formed of some portions of the shell.

13. The plug connector casing of claim 12, comprising a plurality of the receiving parts arranged on one plane normal to the thickness direction and in a plurality of positions along a single row in the width direction in the housing.

14. A plug connector comprising the plug connector casing of claim 12, and the plug contact inserted in the receiving part of the plug connector casing.

15. The plug connector casing of claim 4, wherein the plug connector casing comprises an electrically insulative insulating member and an electrically conductive shell that is put over the insulating member, the housing and the control arms are formed of the insulating member, and the lock arms are formed of some portions of the shell.

16. The plug connector casing of claim 15, comprising a plurality of the receiving parts arranged on one plane normal to the thickness direction and in a plurality of positions along a single row in the width direction in the housing.

17. The plug connector casing of claim 7, wherein the plug connector casing comprises an electrically insulative insulating member and an electrically conductive shell that is put over the insulating member, the housing and the control arms are formed of the insulating member, and the lock arms are formed of some portions of the shell.

18. The plug connector casing of claim 17, comprising a plurality of the receiving parts arranged on one plane normal to the thickness direction and in a plurality of positions along a single row in the width direction in the housing.

19. The plug connector casing of claim 10, wherein the plug connector casing comprises an electrically insulative insulating member and an electrically conductive shell that is put over the insulating member, the housing and the control arms are formed of the insulating member, and the lock arms are formed of some portions of the shell.

20. The plug connector casing of claim 19, comprising a plurality of the receiving parts arranged on one plane normal to the thickness direction and in a plurality of positions along a single row in the width direction in the housing.

* * * * *

UNITED STATES PATENT AND TRADEMARK OFFICE

CERTIFICATE OF CORRECTION

PATENT NO. : 6,957,975 B2
DATED : October 25, 2005
INVENTOR(S) : Kuroda et al.

It is certified that error appears in the above-identified patent and that said Letters Patent is hereby corrected as shown below:

Title page,
Item [56], References Cited, U.S. PATENT DOCUMENTS,
after "3,523,269 A * 8/1970" replace "Bissland et al." with -- Witek, Jr. et al. --.

Column 12,
Line 46, before "fingers" replace "on&s" by -- one's --.

Column 14,
Line 35, after "6. A plug connector" delete -- with --;

Column 15,
Line 15, after "casing of claim" replace "12," with -- 12 --.

Signed and Sealed this

Fourteenth Day of February, 2006

JON W. DUDAS
*Director of the United States Patent and Trademark Office*